US006583724B1

(12) United States Patent
Rodriguez

(10) Patent No.: US 6,583,724 B1
(45) Date of Patent: Jun. 24, 2003

(54) POOL ALARM SYSTEM

(76) Inventor: Raul Rodriguez, 8913 Beeler Dr., Tampa, FL (US) 33626

( * ) Notice: Subject to any disclaimer, the term of this patent is extended or adjusted under 35 U.S.C. 154(b) by 88 days.

(21) Appl. No.: 09/849,711

(22) Filed: May 4, 2001

(51) Int. Cl.[7] ..... G08B 23/00

(52) U.S. Cl. ..... 340/573.6; 340/552; 340/522; 340/556; 340/565

(58) Field of Search ..... 340/565, 541, 340/550, 573.1, 573.6, 556, 521, 522, 552

(56) References Cited

U.S. PATENT DOCUMENTS

| | | | | | |
|---|---|---|---|---|---|
| 2,071,557 | A | * | 2/1937 | Miyaoka | 362/105 |
| 3,636,544 | A | | 1/1972 | Codina | |
| 3,732,556 | A | | 5/1973 | Caprillo et al. | |
| 4,121,200 | A | | 10/1978 | Colmenero | |
| 4,540,976 | A | * | 9/1985 | Wegrzyn | 200/84 R |
| 4,571,579 | A | | 2/1986 | Woolley | |
| D285,665 | S | | 9/1986 | Green | |
| 4,620,181 | A | * | 10/1986 | Sackett | 250/227.11 |
| 4,910,498 | A | | 3/1990 | Feher | |
| 5,023,593 | A | * | 6/1991 | Brox | 340/522 |
| 5,093,650 | A | * | 3/1992 | Kolbatz | 340/521 |
| 5,517,174 | A | * | 5/1996 | Barrows | 340/431 |
| 5,828,304 | A | * | 10/1998 | Mowday | 340/539 |
| 6,157,304 | A | * | 12/2000 | Bennett et al. | 340/522 |
| 6,317,050 | B1 | * | 11/2001 | Burks | 340/573.6 |
| 6,384,726 | B1 | * | 5/2002 | Epple et al. | 340/545.6 |

* cited by examiner

*Primary Examiner*—Benjamin C. Lee

(57) ABSTRACT

A pool alarm system for alerting when an object such as a child has entered a pool filled with water. The pool alarm system includes, a sensor assembly for detecting when an object has entered the water in a pool. The sensor assembly includes a housing that is mountable on a side wall of the pool. A first sensor is mounted on the housing for detecting movement of the surface of the water. In one embodiment of the present invention, the first sensor is designed to detect surface movement of the water in the pool caused by an object entering and disturbing the surface of the water. A warning assembly is provided for warning an individual in a vicinity of the pool that the sensor has been activated. The warning assembly preferably includes a speaker that is mounted on the housing for emitting sound to audibly warn an individual in a vicinity of the pool that the sensor has been activated.

18 Claims, 4 Drawing Sheets

POOL ALARM SYSTEM

BACKGROUND OF THE INVENTION

1. Field of the Invention

The present invention relates to pool alarms and more particularly pertains to a new pool alarm system for alerting when an object such as a child has entered a pool filled with water.

2. Description of the Prior Art

The use of pool alarms is known in the prior art. More specifically, pool alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,732,556; U.S. Pat. No. 3,636,544; U.S. Pat. No. 4,121,200; U.S. Pat. No. 4,571,579; U.S. Pat. No. 4,910,498; and U.S. Pat. No. Des. 285,665.

While these devices fulfill their respective, particular objectives and requirements, the aforementioned patents do not disclose a new pool alarm system. The inventive device includes a sensor assembly for detecting when an object has entered the water in a pool. The sensor assembly includes a housing.that is mountable on a side wall of the pool. A first sensor is mounted on the housing for detecting movement of the surface of the water in the pool. In one embodiment of the present invention, the first sensor is designed to detect surface movement of the water in the pool caused by an object entering and disturbing the surface of the water. A warning assembly is provided for warning an individual in a vicinity of the pool that the sensor has been activated. The warning assembly preferably includes a speaker that is mounted on the housing for emitting sound to audibly warn an individual in a vicinity of the pool that the sensor has been activated.

In these respects, the pool alarm system according to the present invention substantially departs from the conventional concepts and designs of the prior art, and in so doing provides an apparatus primarily developed for the purpose of alerting when an object such as a child has entered a pool filled with water.

SUMMARY OF THE INVENTION

In view of the foregoing disadvantages inherent in the known types of pool alarms now present in the prior art, the present invention provides a new pool alarm system construction wherein the same can be utilized for alerting when an object such as a child has entered a pool filled with water.

The general purpose of the present invention, which will be described subsequently in greater detail, is to provide a new pool alarm system apparatus and method which has many of the advantages of the pool alarms mentioned heretofore and many novel features that result in a new pool alarm system which is not anticipated, rendered obvious, suggested, or even implied by any of the prior art pool alarms, either alone or in any combination thereof.

To attain this, the present invention generally comprises a sensor assembly for detecting when an object has entered the water in a pool. The sensor assembly includes a housing that is mountable on a side wall of the pool. A first sensor is mounted on the housing for detecting movement of the surface of the water in the pool. In one embodiment of the present invention, the first sensor is designed to detect surface movement of the water in the pool caused by an object entering and disturbing the surface of the water. A warning assembly is provided for warning an individual in a vicinity of the pool that the sensor has been activated. The warning assembly preferably includes a speaker that is mounted on the housing for emitting sound to audibly warn an individual in a vicinity of the pool that the sensor has been activated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool alarm system apparatus and method which has many of the advantages of the pool alarms mentioned heretofore and many novel features that result in a new pool alarm system which is not anticipated, rendered obvious, suggested, or even implied by any of the prior art pool alarms, either alone or in any combination thereof.

It is another object of the present invention to provide a new pool alarm system which may be easily and efficiently manufactured and marketed.

It is a further object of the present invention to provide a new pool alarm system which is of a durable and reliable construction.

An even further object of the present invention is to provide a new pool alarm system which is susceptible of a low cost of manufacture with regard to both materials and labor, and which accordingly is then susceptible of low prices of sale to the consuming public, thereby making such pool alarm system economically available to the buying public.

Still yet another object of the present invention is to provide a new pool alarm system which provides in the apparatuses and methods of the prior art some of the advantages thereof, while simultaneously overcoming some of the disadvantages normally associated therewith.

Still another object of the present invention is to provide a new pool alarm system for alerting when an object such as a child has entered a pool filled with water.

Yet another object of the present invention is to provide a new pool alarm system which includes a sensor assembly for detecting when an object has entered the water in a pool. The sensor assembly includes a housing with an interior. The housing is that is mountable on a side wall of the pool. A first sensor is mounted on the housing for detecting movement of the surface of the water in the pool. In one embodiment of the present invention, the first sensor is designed to detect surface movement of the water in the pool caused by an object entering and disturbing the surface of the water. A warning assembly is provided for warning an individual in a vicinity of the pool that the sensor has been activated. The warning assembly preferably includes a speaker that is mounted on the housing for emitting sound to audibly warn an individual in a vicinity of the pool that the sensor has been activated.

Still yet another object of the present invention is to provide a new pool alarm system that alerts an owner of a swimming pool that someone or something has entered the their swimming pool. The alarm reduces the chances of an individual such as a child or a household pet drowning while the owner is not visually monitoring the pool.

Even still another object of the present invention is to provide a new pool alarm system that prevents uninvited guests from entering a pool. The present invention activates a sensor when anyone or anything enters the pool, thereby scaring away any uninvited guests that may enter the pool while the pool owner is away from the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
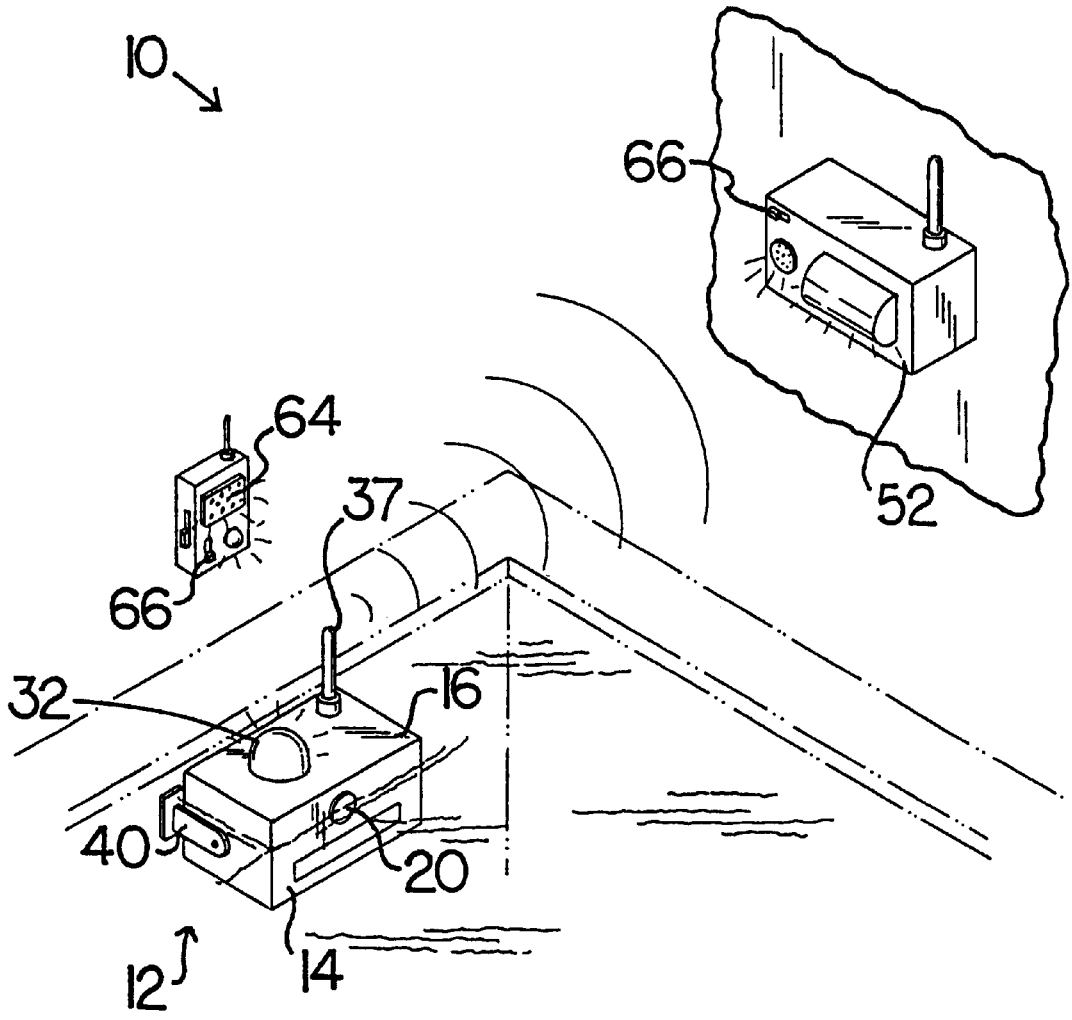
FIG. 1 is a schematic perspective view of a new pool alarm system according to the present invention.

With reference now to the drawings, and in particular to FIGS. 1 through 4 thereof, a new pool alarm system embodying the principles and concepts of the present invention and generally designated by the reference numeral 10 will be described.

As best illustrated in FIGS. 1 through 4, the pool alarm system 10 generally comprises a sensor assembly 12 for detecting when the object such as for example, a child, a pet or a wild animal has entered the water in the pool. The sensor assembly preferably includes a housing 13 that has a front wall 14, a back wall 15, a top wall 16, a bottom wall 17 and a pair of side walls 18 such that the housing 13 has an interior 19. The housing 13 may be mountable on a side wall of the pool. The housing 13 may comprise a rigid material such as, for example, a plastic or metal material. Since the housing 13 is positionable in the water of the pool, the housing 13 is preferably sealed to prevent water from entering the interior 19 of the housing 13.

In order to alert an owner of a pool that someone has entered the pool, a first sensor 20 is provided for detecting movement of the surface of the water in the pool. The first sensor 20 may be pivotally mounted on the front wall 14 of the housing 13 and positioned generally at a water level of the water in the pool. In one embodiment of the present invention, the first sensor is designed to detect surface movement of the water in the pool caused by an object entering and disturbing the surface of the water, which causes the first sensor 20 to pivot with respect to the housing 13. The first sensor 20 may comprise a generally buoyant material such as, for example, a cork or plastic material.

A second sensor 22 may be provided for detecting movement in the water of the pool. The second sensor 22 may be mounted on the bottom wall 17 of the housing 13 and emitting a light across an entire length of the pool. In one embodiment of the present invention, the second sensor 22 is designed for detecting an object entering the pool by the object selectively engaging the light that is emitted from the second sensor 22. The second sensor may comprise an infrared sensor.

A third sensor 24 may be provided for detecting a temperature change in the water from an object emitting heat entering the water. The third sensor 24 may be mounted on the bottom wall 17 of the housing 13 and positioned generally adjacent to the second sensor 22. In one embodiment of the present invention, the third sensor 24 is designed to detect a temperature change in the water caused by an object entering the pool and emitting heat. The third sensor 24 may comprise a mercury thermometer.

Control circuitry 26 is mounted in the interior 19 of the housing 13. The control circuitry 26 is designed for controlling each of the sensors 20, 22 and 24. A power supply 27 may be provided for selectively providing power to the control circuitry 26. The power supply 27 may be removably mounted in the interior 19 of the housing 13. The power supply 27 may comprise a battery, although other sources of power may be employed.

A warning assembly 30 is provided for warning an individual in a vicinity of the pool that one of the sensors 20, 22 and 24 has been activated. The warning assembly 30 may include a light member 32 for emitting light to visual warn an individual in a vicinity of the pool that one of the sensors 20, 22 and 24 has been activated. The light member 32 may be mounted on the top wall 16 of the housing 13 and is electrically connected to the control circuitry 26. The light member 32 may comprise a light bulb.

The warning assembly 30 may include a speaker 34 for emitting sound to audibly warn an individual in a vicinity of the pool that one of the sensors 20, 22 and 24 has been activated. The speaker 34 may be mounted on the top wall 16 of the housing 13 and positioned generally adjacent to the light member 32. The speaker 34 is electrically connected to the control circuitry 26.

A transmitter 36 may be provided for generating a signal that one.of the sensors. 20, 22 and 24 has been activated. The transmitter 36 may be mounted in the interior 19 of the housing 13 and electrically connected to the control circuitry 26. An antenna 37 may be provided for sending the signal-.from the transmitter 36. The antenna 37 may be mounted on the top wall 16 of the housing 13 and electrically connected to the transmitter 36.

A pair of fastening members 40 may be provided for mountably fastening the sensor assembly 12 to the side wall of the pool. Each of the fastening members 40 may include a foot portion 41 and an elongated leg portion 42. The foot portion 41 includes a front surface 43 and a back surface 44. The back surface 44 of the foot portion 41 is mountable to the side wall of the pool. The leg portion 42 is mounted on the front surface 43 of the foot portion 41 and orientated generally perpendicular to the foot portion 41. An end 45 of each of the leg portions 42 is mounted on one of the side walls 18 of the housing 13.

Figure 2:
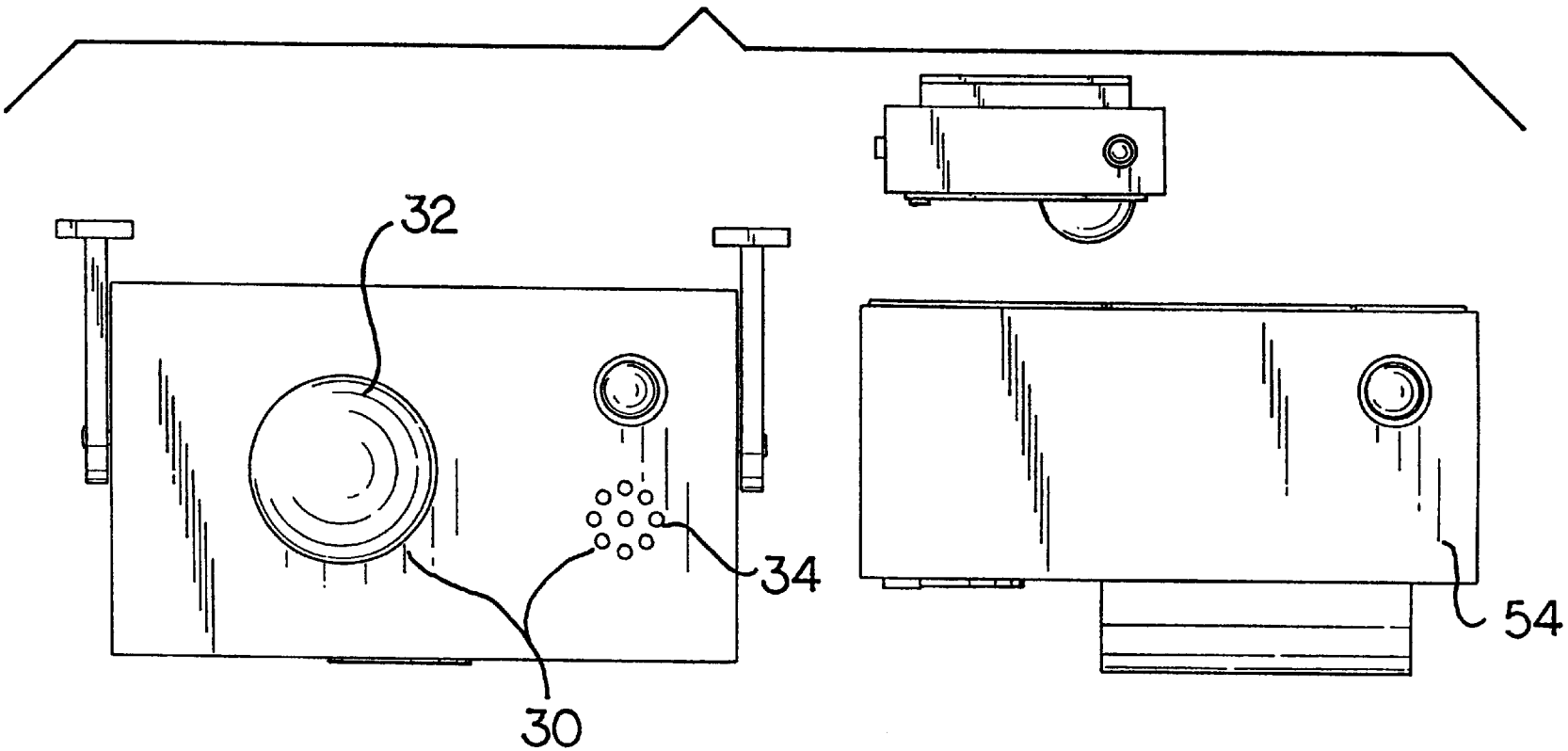
FIG. 2 is a schematic top view of the present invention.
Figure 3:
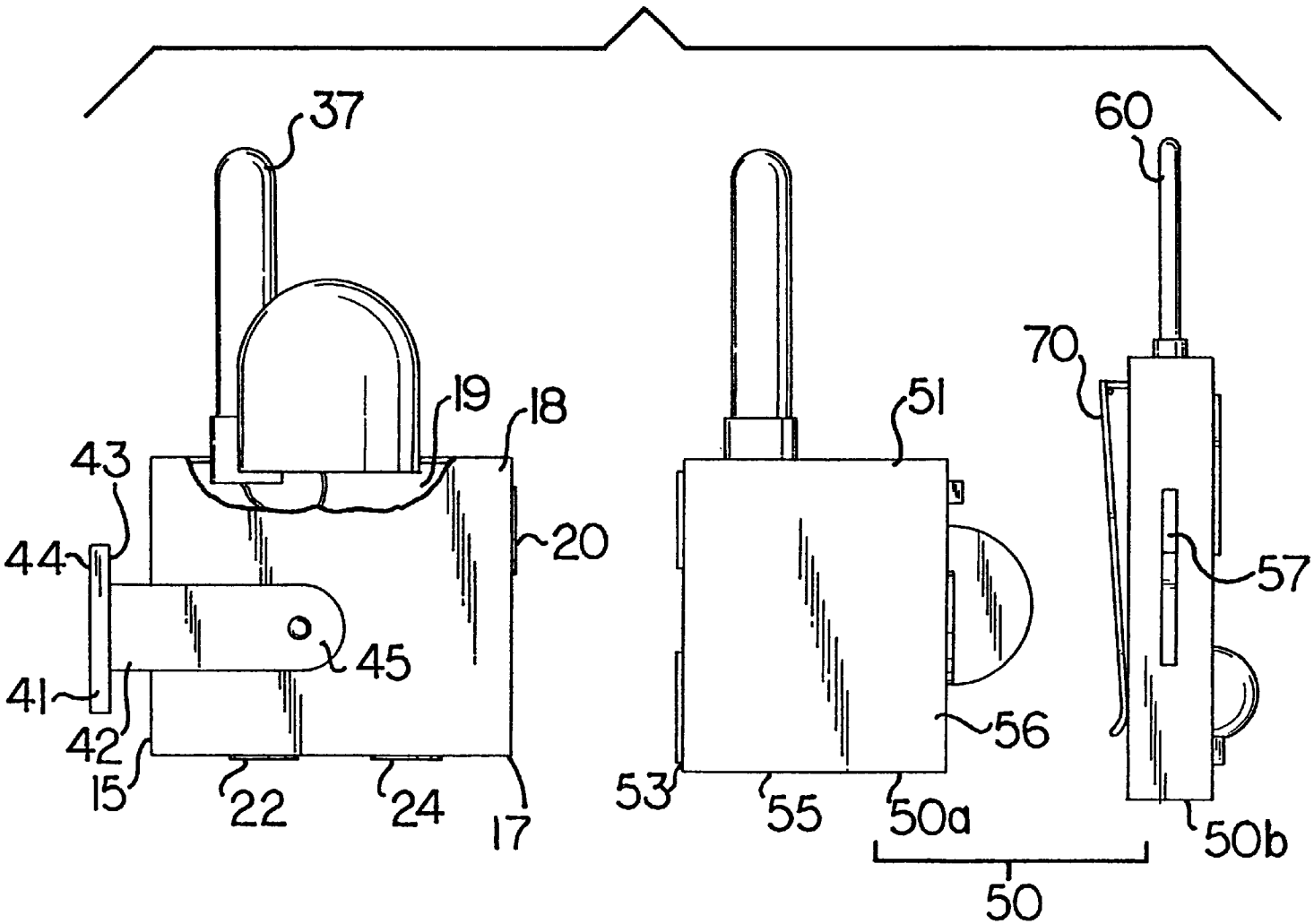
FIG. 3 is a schematic side view of the present invention.
Figure 4:
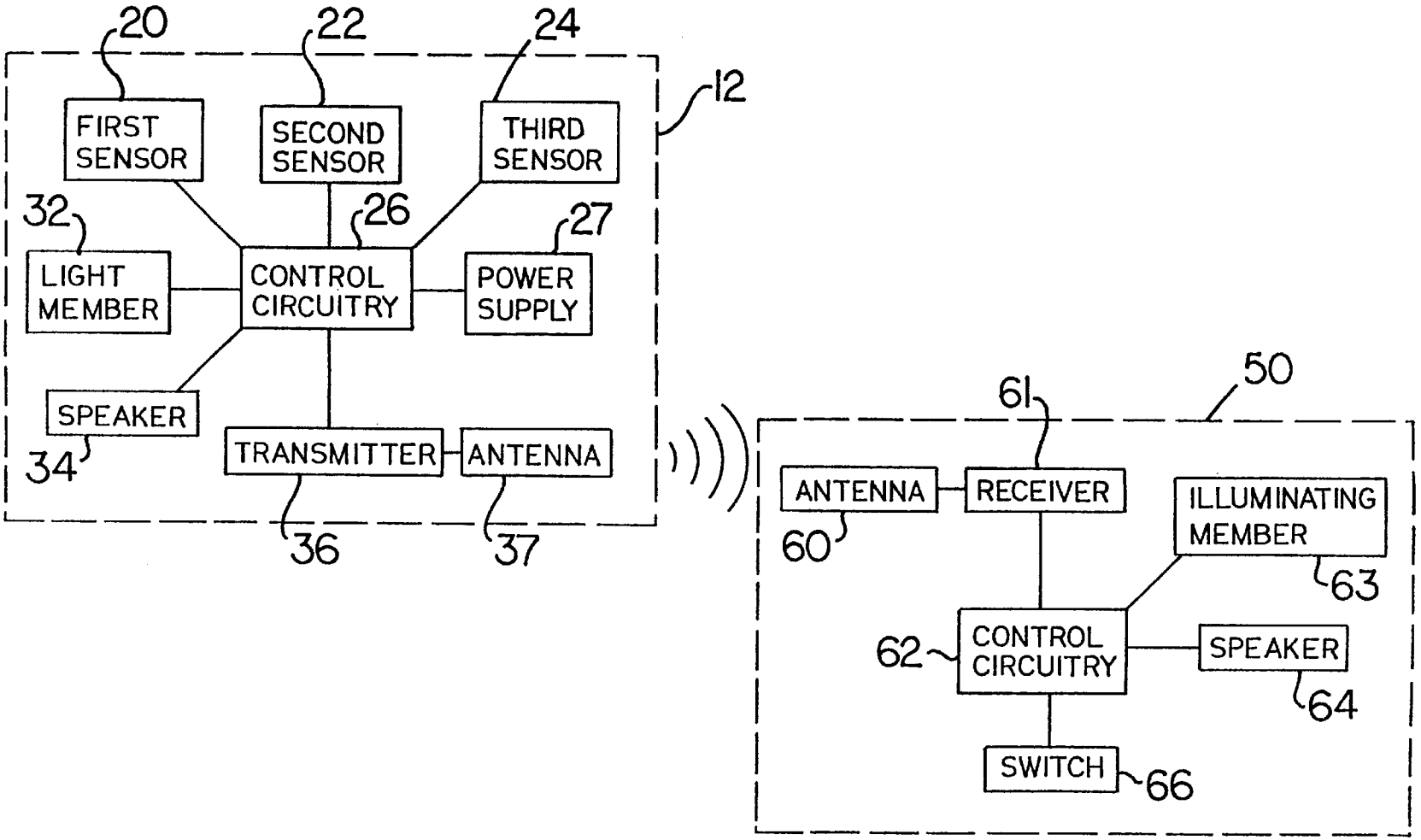
FIG. 4 is a schematic diagram of the present invention.

A signaling assembly 50 may be provided for alerting an individual remote from the pool that one of the sensors 20, 22 and 24 has been activated. As illustrated in FIGS. 1,2 and 3, at least two embodiments 50*a* and 5*b* of the signaling assembly 50 may be employed. Both of the signaling assemblies 50*a* and 50*b* may include an enclosure 51 that has a front wall 52, a back wall 53, a top wall 54, a bottom wall 55 and a pair of lateral side walls 56 such that the enclosure 51 has an interior 57. The enclosure 51 may comprise a substantially rigid material such as, for example, a plastic material.

An antenna 60 may be provided for receiving the signal from the antenna 37 of the housing 13. The antenna 60 of the enclosure 51 may be mounted on the top wall 54 of the enclosure 51. A receiver 61 may be provided for amplifying the signal received by the antenna 60 of the enclosure 51. The receiver 61 may be mounted in the interior 57 of the enclosure 51. The receiver 61 is electrically connected to the antenna 60 of the enclosure 51.

Control circuitry 62 mounted in the interior 57 of the enclosure 52 is designed for controlling reception of the signal from the sensor assembly 12. The control circuitry 62 of the enclosure 51 may be mounted in the interior 57 of the enclosure 51.

An illuminating member 63 may be provided for emitting light to visual warn an individual remote from the pool that one of the sensors 20, 22 and 24 has been activated. The illuminating member 63 may be mounted on the front wall 52 of the enclosure 51. The illuminating member 63 may comprise a light bulb.

A speaker 64 may be provided for emitting sound to audibly warn an individual remote from the pool that one of the sensors 20, 22 and 24 has been activated. The speaker 64 of enclosure 51 may be mounted on the front wall 52 of the enclosure 51 and positioned generally adjacent to the illuminating member 63. The speaker 64 of the enclosure 51 is electrically connected to the control circuitry 62 of the enclosure 51.

A switch 66 may be provided for selectively providing power to the control circuitry 62 of the enclosure 51. The switch 66 may be mounted on the front wall 52 of the enclosure 51 and positioned generally adjacent to the speaker of the enclosure.

As illustrated in FIG. 3, a securing member 70 may be provided for the signaling assembly 50*b* for removably securing the enclosure 51 to an article of clothing of a user. The securing member 70 may be mounted on the back wall 53 of the enclosure 51. The securing member 70 may comprise a clip.

In use, the signaling assembly 50 alerts an owner of a pool that that someone or something has entered their pool. The signaling assembly illustrated by embodiment 50*a* may be used while the owner of the pool is in their house and not in the immediate vicinity of the pool. The signaling assembly illustrated by embodiment 50*b* may be used when the owner of the pool that is some distance away from home. Once someone or something enters the pool one of the sensors is activated, sending a signal to the signaling assembly 50 alerting the owner of the pool.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool alarm system for providing an alert when an object has entered a pool filled with water, said system comprising:

a sensor assembly for detecting when the object has entered the water in the pool, said sensor assembly including:

a housing having an interior, said housing being mountable on a side wall of the pool;

a first sensor mounted on said housing for detecting movement of the surface of the water in the pool, wherein said first sensor is adapted to detect surface movement of the water in the pool caused by an object entering and disturbing the surface of the water;

a second sensor being mounted on said housing for detecting movement in the water of the pool, said second sensor emitting a light, wherein said second sensor is adapted for detecting an object entering the pool by the object selectively interrupting said light being emitted from said second sensor;

a third sensor mounted on said housing for detecting a temperature change in the water from an object emitting heat entering the water; and a warning assembly for warning an individual in a vicinity of the pool that one of said sensors has been activated, said warning assembly including a speaker being mounted on said housing for emitting sound to audibly warn an individual in a vicinity of the pool that one of said sensors has been activated.

2. The pool alarm system of claim 1, wherein said first sensor is pivotally mounted on a front wall of said housing.

3. The pool alarm system of claim 2, wherein said first sensor comprises a generally buoyant material.

4. The pool alarm system of claim 1, wherein said second sensor comprises an infrared sensor.

5. The pool alarm system of claim 1, wherein said third sensor comprises a thermometer.

6. The pool alarm system of claim 5, additionally including control circuitry mounted in said interior and being adapted for controlling each of said sensors.

7. The pool alarm system of claim 6, additionally including a power supply removably mounted in said interior of said housing for selectively providing power to said control circuitry.

8. The pool alarm system of claim 1, additionally including a light member mounted on said housing for emitting light to visual warn an individual in a vicinity of the pool that said sensor has been activated.

9. The pool alarm system of claim 1, additionally including a transmitter mounted in said interior of said housing for generating a signal that said sensor has been activated.

10. The pool alarm system of claim 9, additionally including an antenna mounted on said housing for sending said signal from said transmitter.

11. The pool alarm system of claim 10, additionally including a signaling assembly for alerting an individual remote from the pool that one of said sensors has been activated, said signaling assembly including:

an enclosure having an interior;

an antenna mounted on said enclosure for receiving said signal from said antenna of said housing;

a receiver mounted in said interior for amplifying said signal received by said antenna of said enclosure;

control circuitry mounted in said interior of said enclosure being adapted for controlling reception of said signal from said sensor assembly; and a speaker mounted on said housing for emitting sound to audibly warn an individual remote from the pool that said sensor has been activated.

12. The pool alarm system of claim 11, additionally including an illuminating member mounted on said enclosure for emitting light to visual warn an individual remote from the pool that said sensor has been activated.

13. The pool alarm system of claim 12, additionally including a switch mounted on said enclosure for selectively providing power to said control circuitry of said enclosure.

14. The pool alarm system of claim 11, additionally including a securing member mounted on said enclosure for removably securing said enclosure to an article of clothing of a user.

15. The pool alarm system of claim 14, wherein said securing member comprises a clip.

16. The pool alarm system of claim 1, additionally including a pair of fastening members for mountably fastening said sensor assembly to the side wall of the pool, each of said fastening members including a foot portion and an elongated leg portion.

17. The pool alarm system of claim 16, wherein said foot is adapted for mounting to the side wall of the pool, an end of said leg portions being mounted on one of a pair of side walls of said housing.

18. A pool alarm system for providing an alert when an object has entered a pool filled with water, said system comprising:

a sensor assembly for detecting when the object has entered the water in the pool, said sensor assembly including:

a housing having a front wall, a back wall, a top wall, a bottom wall and a pair of side walls such that said housing has an interior, said housing being mountable on a side wall of the pool, said housing comprising a substantially rigid material;

a first sensor for detecting movement of the surface of the water in the pool, said first sensor being pivotally mounted on said front wall of said housing and positioned generally at a water level of the water in the pool, wherein said first sensor is adapted to detect surface movement of the water in the pool caused by an object entering and disturbing the surface of the water which causes said first sensor to pivot with respect to said housing, said first sensor comprising a generally buoyant material;

a second sensor for detecting movement in the water of the pool, said second sensor being mounted on said bottom wall of said housing, said second sensor emitting a light, wherein said second sensor is adapted for detecting an object entering the pool by the object selectively engaging said light being emitted from said second sensor, said second sensor comprising an infrared sensor;

a third sensor for detecting a temperature change in the water from an object emitting heat entering the water, said third sensor being mounted on said bottom wall of said housing and positioned generally adjacent to said second sensor, wherein said third sensor is adapted to detect a temperature change in the water caused by an object entering the pool and emitting heat;

control circuitry being adapted for controlling each of said sensors, said control circuitry being mounted in said interior of said housing;

a power supply for selectively providing power to said control circuitry, said power supply being removably mounted in said interior of said housing, said power supply comprising a battery;

a warning assembly for warning an individual in a vicinity of the pool that one of said sensor has been activated, said warning assembly including:

a light member for emitting light to visual warn an individual in a vicinity of the pool that one of said sensors has been activated, said light member being mounted on said top wall of said housing, said light member being electrically connected to said control circuitry;

a speaker for emitting sound to audibly warn an individual in a vicinity of the pool that one of said sensors has been activated, said speaker being mounted on said top wall of said housing and positioned generally adjacent to said light member, said speaker being electrically connected to said control circuitry;

a transmitter for generating a signal that one of said sensors has been activated, said transmitter being mounted in said interior of said housing, said transmitter being electrically connected to said control circuitry an antenna for sending said signal from said transmitter, said antenna being mounted on said top wall of said housing, said antenna being electrically connected to said transmitter;

a pair of fastening members for mountably fastening said sensor assembly to the side wall of the pool, each of said fastening members including a foot portion and an elongated leg portion, said foot portion having a front surface and a back surface, said back surface of said foot portion being mountable to the side wall of the pool, said leg portion being mounted on said front surface of said foot portion and orientated generally perpendicular to said foot portion, an end of each of said leg portions being mounted on one of said side walls of said housing;

a signaling assembly for alerting an individual remote from the pool that one of said sensors has been activated, said signaling assembly including:

an enclosure having a front wall, a back wall a top wall, a bottom wall and a pair of lateral side walls such that said enclosure has an interior, said enclosure comprising a substantially rigid material;

an antenna for receiving said signal from said antenna of said housing, said antenna of said enclosure being mounted on said top wall of said enclosure;

a receiver for amplifying said signal received by said antenna of said enclosure, said receiver being mounted in said interior of said enclosure, said receiver being electrically connected to said antenna of said enclosure;

control circuitry being adapted for controlling reception of said signal from said sensor assembly, said control circuitry of said enclosure being mounted in said interior of said enclosure;

an illuminating member for emitting light to visual warn an individual remote from the pool that one of said sensors has been activated, said illuminating member being mounted on said front wall of said enclosure;

a speaker for emitting sound to audibly warn an individual remote from the pool that one of said sensors has been activated, said speaker of enclosure being mounted on said front wall of said enclosure and positioned generally adjacent to said illuminating member, said speaker of said enclosure being electrically connected to said control circuitry of said enclosure;

a switch for selectively providing power to said control circuitry of said enclosure, said switch being mounted on said front wall of said enclosure and positioned generally adjacent to said speaker of said enclosure; and a securing member for removably securing said enclosure to an article of clothing of a user, said securing member being mounted on said back wall of said enclosure, said securing member comprising a clip.

* * * * *